United States Patent [19]

Schmitz

[11] 4,242,034

[45] Dec. 30, 1980

[54] QUICK-RELEASE COUPLING

[75] Inventor: Floyd A. Schmitz, Burlington, Iowa

[73] Assignee: J. I. Case Company, Racine, Wis.

[21] Appl. No.: 961,105

[22] Filed: Nov. 16, 1978

[51] Int. Cl.[3] ..... E02F 3/81

[52] U.S. Cl. ..... 414/686; 414/723; 172/272

[58] Field of Search ..... 414/685, 723; 172/272, 172/274, 275; 403/43, 45, 48

[56] References Cited

U.S. PATENT DOCUMENTS

| | | | |
|---|---|---|---|
| 3,220,487 | 11/1965 | Pilch | 414/686 X |
| 3,818,551 | 6/1974 | Coughran, Jr. | 414/723 X |
| 3,844,425 | 10/1974 | Bailey | 172/274 X |
| 3,935,953 | 2/1976 | Stedman | 414/723 X |
| 4,013,182 | 3/1977 | Pratt et al. | 172/272 X |
| 4,034,998 | 7/1977 | Iijima et al. | 172/272 X |
| 4,116,346 | 9/1978 | Uchida | 414/723 |
| 4,127,203 | 11/1978 | Arnold | 172/272 X |

*Primary Examiner*—Robert G. Sheridan

*Assistant Examiner*—Terrance L. Siemens

*Attorney, Agent, or Firm*—Dressler, Goldsmith, Shore, Sutker & Milnamow, Ltd.

[57] ABSTRACT

A quick-release coupling is provided between a vehicle and a material handling unit. The frame of the vehicle has a pair of opposed recesses. A linkage which is connected to the material handling unit includes first and second links which are pivotally interconnected at one end. Elements such as pins are associated with the opposite ends of the links and are each receivable in one of the recesses. A third link has one end secured to the material handling unit and an opposite end which is pivotally interconnected with the first and second links. The third link moves the first and second links between a first position in which the distance between the axes of the pins is less than the distance of the opposed recesses, and a second position in which the distance between the axes of the pins is greater than the distance between the opposed recesses and the pins are received in the repective recesses to releasably secure the material handling unit to the vehicle.

9 Claims, 5 Drawing Figures

QUICK-RELEASE COUPLING

BACKGROUND OF THE INVENTION

The present invention relates to material handling implements and more specifically to a releasable coupling between a material handling unit and the supporting vehicle.

In recent years, tractor-mounted implements have become very common and, because of the large amount of investment for the tractor, it has become customary to design the tractor for use with more than one implement. One type of dual implement vehicle consists of a bucket loader or other type of earth handling implement on the front end of the tractor while another type of earth working implement, such as a backhoe, is mounted on the opposite end of the tractor.

In many instances, it becomes desirable to remove the backhoe from the tractor, as when the vehicle is being utilized as a loader. For this purpose, it has been proposed to provide quick-release couplings between the earth working unit or backhoe and the vehicle so that the unit can readily be detached from the vehicle whenever desired.

Prior art couplings have the disadvantage that a person performs the securement or detachment of the material handling unit and the vehicle on the side of the vehicle between the wheels of the vehicle and the outriggers that stabilize the tractor while digging takes place. This is a difficult position in which to perform such a function, particularly because there is usually only a small space between the wheels and the outriggers since it is desirable to position the outriggers as close as possible to the wheels of the vehicle. In addition, many prior art attaching arrangements are extremely expensive and are rather complex, adding to the service requirements for the vehicle.

SUMMARY OF THE INVENTION

The quick-release coupling of the present invention connects an implement unit to a vehicle in such a manner such that a person accomplishes the connection or detachment from the rear of the vehicle rearwardly of the outriggers rather than on the side of the vehicle between the wheels of the vehicle and the outriggers.

The vehicle frame has a pair of opposed recesses. A linkage means is connected to the material handling unit and includes first and second links which are pivotally interconnected at one end. First means is associated with the opposite end of the first link which is receivable in one of the recesses, and second means is associated with the opposite end of the second link which is receivable in the other recess.

A third link is axially extendable and retractable and has one end secured to the material handling unit and an opposite end which is interconnected with the one end of the first and second links. The third link is adapted to move the first and second links between a first position in which the distance between the first means and the second means is less than the distance between the opposed recesses, and a second position in which the distance between the first means and the second means is greater than the distance between the opposed recesses and the first and second means are received in the respective recesses to releasably secure the material handling unit to the vehicle.

In one embodiment of the invention, the material handling unit defines a pair of elongated openings which are alignable with the recesses when the first and second links are in the second position. The first means is receivable in one of the elongated openings, and the second means is receivable in the other elongated opening. The first and second means are movable in the respective elongated openings when the first and second links are moved between the first and second positions. In this embodiment, guide means is provided for the third link so that the third link moves only in the axial direction when it is extended or retracted.

In the second embodiment of the invention, the second means is secured to the frame of the material handling unit so that the second link pivots about the end of the second link which is associated with the second means. The material handling unit defines one elongated opening in which the first means is receivable and is movable therein when the third link is extended or retracted.

DETAILED DESCRIPTION OF THE PREFERRED EMBODIMENTS

Figure 1:
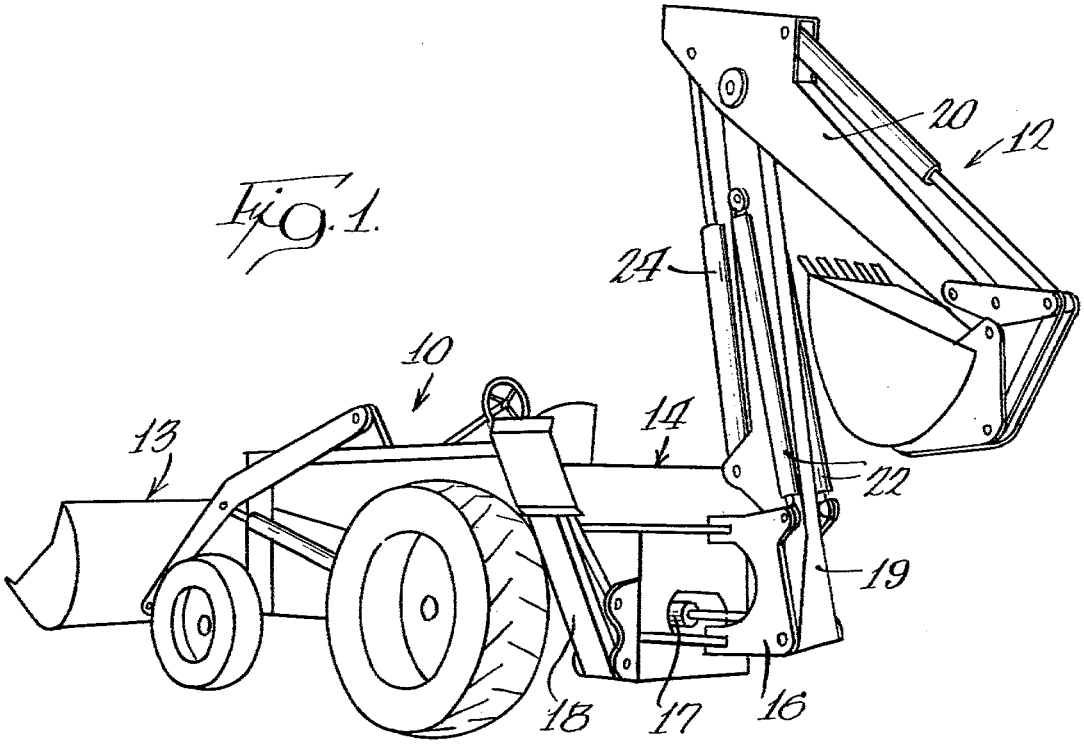
FIG. 1 is a perspective view of a tractor vehicle having a material handling unit at each end.

While this invention is susceptible of embodiment in many different forms, there is shown in the drawings and will herein be described in detail several embodiments, with the understanding that the present disclosure is to be considered as an exemplification of the principles of the invention and is not intended to limit the invention to the embodiments illustrated.

FIG. 1 of the drawings shows a vehicle 10 which is a tractor having a material handling unit 12 supported on one end thereof. The opposite end of the tractor normally has another type of material handling unit, such as bucket loader 13 supported thereon.

Figure 2:
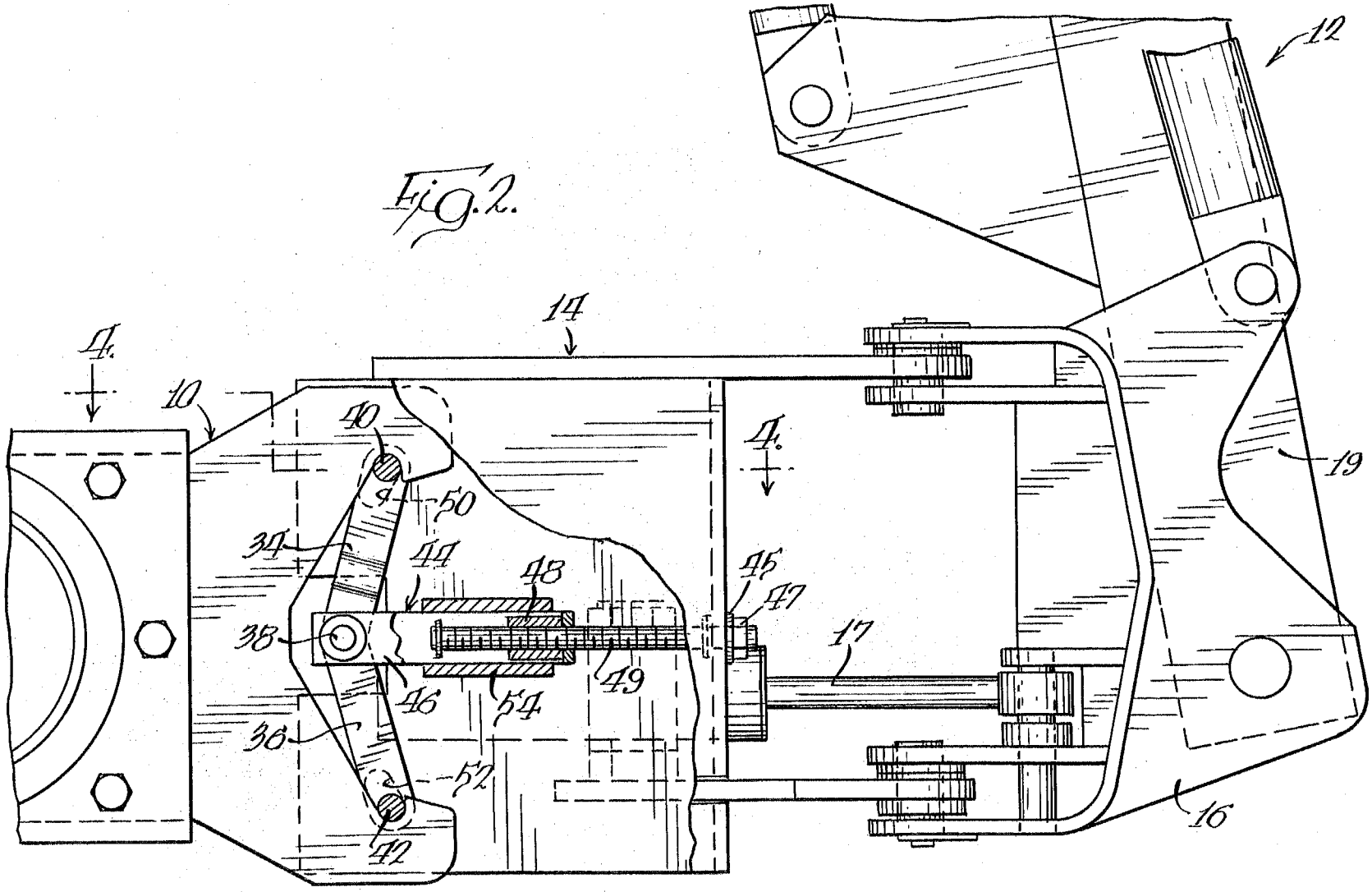
FIG. 2 is an enlarged side elevational of the quick-release coupling between the vehicle and the rear material handling unit.

The material handling unit 12, which is illustrated as a backhoe, consists of a frame 14 secured to the tractor adjacent the rear end thereof and supports a swing tower 16 for pivotal movement about a vertical axis through a fluid ram 17 (FIG. 2). The frame 14 has a pair of outriggers 18 (one being shown) that stabilize the unit during a digging operation.

A boom 19 is pivoted about a horizontal pivot at one end on the swing tower while the opposite end of the boom has a dipper stick assembly 20 pivoted thereon. The pivoting of the boom on the swing tower is accomplished by a pair of fluid rams 22 extending on opposite sides of the boom and connected to the swing tower. The dipper stick assembly 20 is pivoted on the boom through a fluid ram 24, which is interposed between the boom and dipper stick assembly. The vehicle 10 has a frame that defines a pair of opposed recesses 30 and 32. The recesses 30 and 32 are slots that each have an open end facing the opposite recess.

Figure 3:
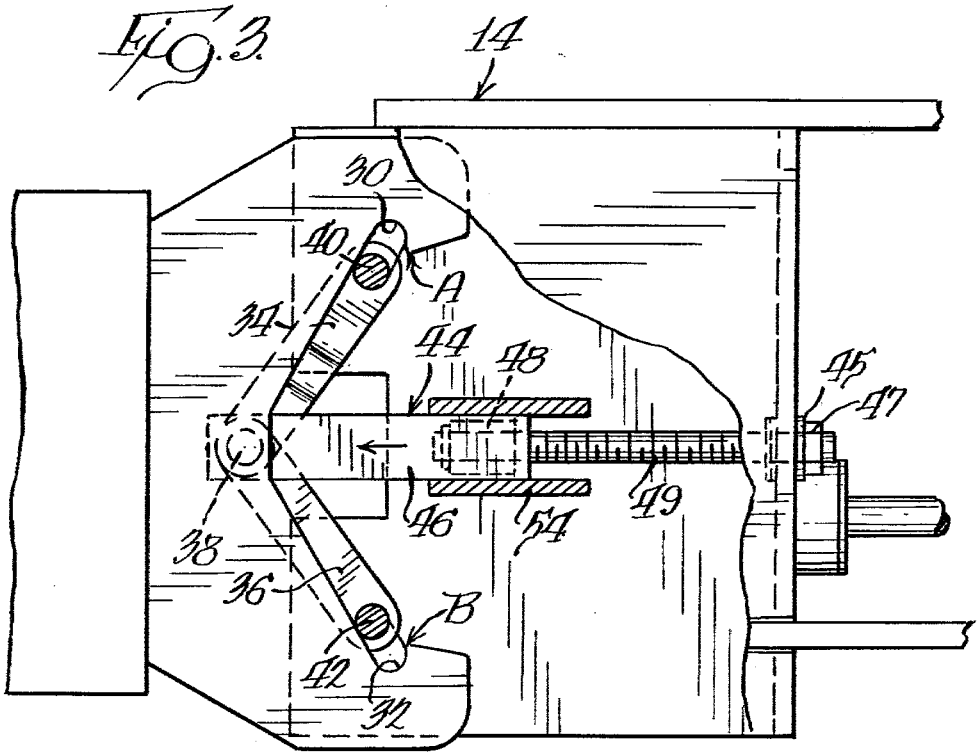
FIG. 3 is a side elevation view of the vehicle and the material handling unit in the detached position.
Figure 4:
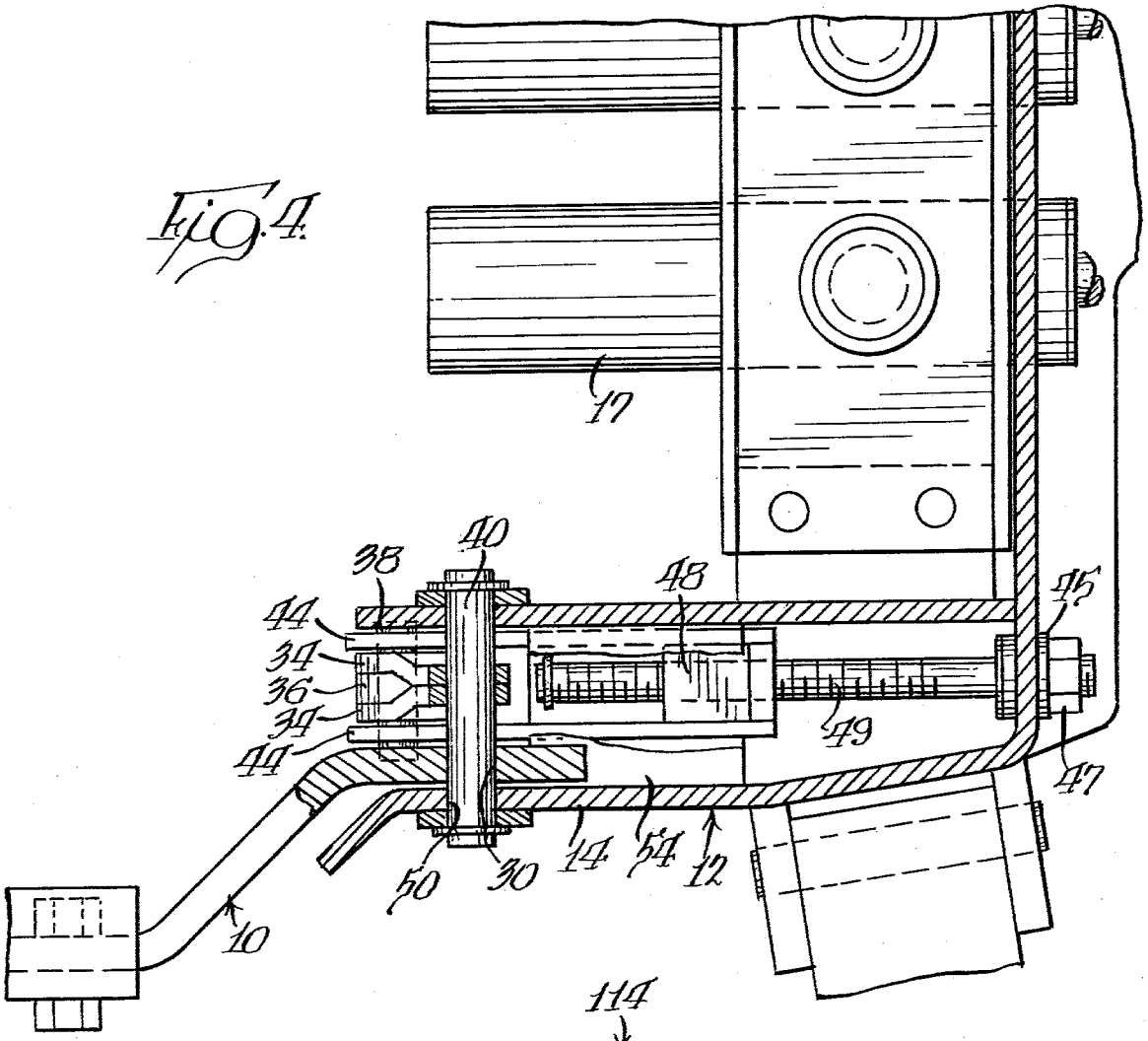
FIG. 4 is a fragmentary cross-sectional view taken along line 4—4 in FIG. 2.

The material handling unit is detachably connected to the vehicle by the linkage means of the present invention, one embodiment of which is shown on FIGS. 2 through 4. The linkage means is secured to the material handling unit and includes a first link 34 and a second link 36 which are pivotally interconnected at one end by pivot pin 38. As shown in FIG. 4, first link 34 and second link 36 each include a pair of members interconnected at one end by pivot pin 38, and are interconnected at the opposite end by pins 40 and 42, respectively. Referring to FIGS. 2 and 3, pin 40 is receivable in recess 30, and pin 42 is receivable in recess 32, as described in greater detail hereinbelow.

The linkage means includes a third link 44 which is movable axially between the retracted position shown in FIG. 2 and the extended position shown in FIG. 3. One end of link 44 is secured to the frame 14 of the material handling unit 12, and the opposite end of link 44 is interconnected with links 34 and 36 by means of pin 38. To enable the third link to extend and retract and remain rigid at all times, the third link preferably is formed of two members—first member 46 which is interconnected with links 34 and 36 and includes a hollow segment 48 having an internal screw thread, and second member 49 which has one end secured to the material handling unit 12 by element 45 and an opposite end which has an external screw thread which is received in segment 48 of the second member 46. An operator can rotate second element by using a wrench about the nut 47. The nut 47 is positioned at an accessible location away from the outrigger 18 at the rear of the vehicle.

The material handling unit is releasably connected to the vehicle as follows. Where the first link 34 and second link 36 are disposed at an acute angle relative to the third link 44, as shown in FIGS. 2 and 3, rotation of the second member 49 causes the first member 46 to move inwardly or outwardly along the axis of the third link 44, thereby moving the first link 34 and second link 36 due to the movement of pin 38.

More specifically, the linkage means is shown in a detached position in FIG. 3. In this position, pins 40 and 42 are in a clearance position and are not received in recesses 30 and 32. By rotating the second member 49 in one direction, the first member 46 is moved inwardly until it assumes its fully retracted position which is shown in FIG. 2. In the retracted position, the pins 40 and 42 are received in and engage the recesses 30 and 32 to lock the material handling unit to the vehicle.

The reverse procedure is followed to detach the material handling unit from the vehicle. The second member 49 is rotated in the opposite direction which causes the first member 46 to move outwardly until it assumes the fully extended position in which the pins 40 and 42 are clear of recesses 30 and 32. Accordingly, the material handling unit can be detached from the vehicle.

As shown in FIGS. 2 and 3, the linkage means is movable between a first clearance position (FIG. 3) in which the pins 40 and 42 are spaced from the recesses 30 and 32 but are alignable with the recesses, and a second engaged position (FIG. 2) in which the pins 40 and 42 are received in both recesses 30 and 32 to releasably secure the material handling unit to the vehicle. In the first position, the distance between the axes of pins 40 and 42 is less than the distance between the mouths of the recesses 30 and 32, i.e., the distance between points A and B in FIG. 3. In the second position, the distance between the axes of pins 40 and 42 is greater than the distance between the mouths of the recesses 30 and 32.

Thus, when referring to the "clearance position," one of the pins may be in engagement with one of the recesses, but at least one of the pins is free of engagement with a recess; moreover there is sufficient clearance such that the material handling unit can be adjusted vertically, following which the tractor can be moved forward and away from the material handling unit.

To guide the movement of the pins 40 and 42 as the third link is being extended or retracted, at least one channel is provided in the frame 14 of the material handling unit 12.

More particularly, in the embodiment illustrated in FIGS. 2 and 3, two channels are provided - channel 50 engages and guides pin 40 and channel 52 engages and guides pin 42. Channels 50 and 52 are elongated openings in which pins 40 and 42, respectively, are received. The channels are oriented generally vertically and are in alignment with recesses 30 and 32. The width of the channel is slightly greater than the diameter of pins 40 and 42, and the length of the channels is sufficient to accommodate movement of the free end of the links 34 and 36 as the end of the links 34 and 36 connected to pin 38 moves between the extended and retracted positions of the third link 44.

Further guide means is preferably also provided in the embodiment shown in FIGS. 2 and 3. To constrain the third link 44 and prevent the third link from moving perpendicularly to its axis, a guide rail 54 is provided. The guide rail 54 surrounds at least a portion of segment 48 of the first member 46 of the third link 44.

With the first link 34, second link 36 and third link 44 thusly constrained, pins 40 and 42 travel approximately equal distances when the third link 44 is extended or retracted.

The mounting procedure for the embodiment shown in FIGS. 2 and 3 includes the steps of backing the vehicle into position, connecting the hydraulics between the vehicle and the material handling unit, raising or lowering the material handling unit to the approximate required height for mounting to the vehicle, backing the vehicle into the material handling unit until the pins 40 and 42 are vertically aligned with the recesses 30 and 32, while the material handling unit is positioned against a stop, and rotating the second member 49 to move the linkage means from the extended position to the retracted position. The pins 40 and 42 will pilot the material handling unit to the vehicle.

Figure 5:
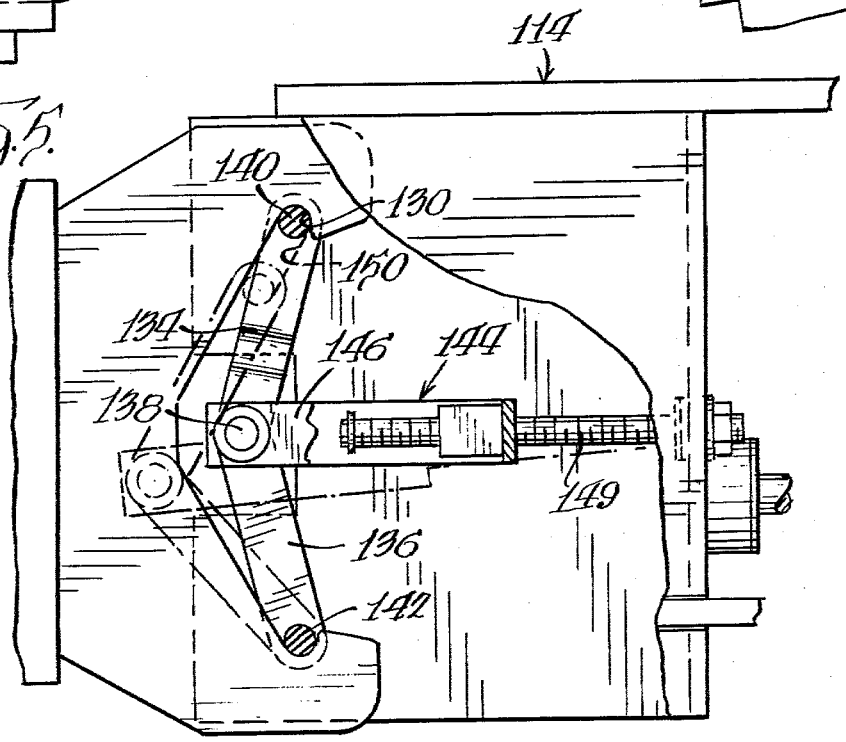
FIG. 5 is a fragmenatry side elevation of the vehicle and material handling unit with a slightly modified quick-release coupling.

Another embodiment is illustrated in FIG. 5, in which numerals in the one hundred series are used, with the same last two digits in each numeral designating identical elements in both embodiments.

In the embodiment shown in FIG. 5, pin 142 which extends through an opening in one end of the second link 136 is secured to the frame of the material handling unit, so that the second link pivots about pin 142 which is stationary. Only the pin 140 through the first link 134 is guided by a channel 150 in the frame 114 of the material handling unit. Unlike the embodiment shown in FIGS. 2 and 3, the embodiment of FIG. 5 does not include a guide rail 54.

The linkage means is shown in the retracted position in solid lines in FIG. 5, and in the extended position in phantom. In the extended position, at least one of the pins, i.e., pin 140, is in a clearance position and is not received in recess 130.

To secure the material handling unit to the vehicle, the second member 149 is rotated in one direction until the first member 146 is moved inwardly to the fully retracted position shown in solid lines in FIG. 5. In the retracted position, the pins 140 and 142 are both received in and engage the recesses 130 and 132 to lock the material handling unit to the vehicle. As can be seen in FIG. 5, there is vertical movement of the third link 144 as well as axial movement when the third link is extended or contracted, due to the effect of pin 142 being anchored to the frame of the material handling unit.

The reverse procedure is followed to detach the material handling unit from the vehicle. The second member 149 is rotated in the opposite direction which causes the first member 146 to move outwardly until it assumes the fully extended position in which pin 140 is not received in recess 130.

Accordingly, the material handling unit could be detached from the vehicle by raising the material handling unit until there is clearance between pins 140 and 142 and the respective recesses 130 and 132, and then moving the vehicle away from the material handling unit.

The mounting procedure for the embodiment shown in FIG. 5 includes the steps of backing the vehicle into position, connecting the hydraulics between the vehicle and the material handling unit, raising or lowering the material handling unit to the approximate required height for mounting to the vehicle, backing the vehicle into the material handling unit and lowering the material handling unit until the pin 142 is received in the recess 132, pushing the material handling unit into the correct top mounting position as with the dipper of a backhoe until pin 140 is vertically aligned with recess 130, and turning the second member 149 to move the linkage means from the extended position to the retracted position.

In both embodiments, the figures show a quick-release coupling which is positioned along one side of the material handling unit and is detachably connected to the vehicle near one side of the vehicle, rearwardly of the outriggers. This can be best seen by referring to FIG. 4. It should be noted that a like assembly is provided which is positioned along the opposite side of the material handling unit and is detachably connected to the vehicle in the same manner near the opposite side of the vehicle.

What is claimed is:

1. A quick-release coupling between a vehicle and a material handling unit supported on the vehicle, comprising:

a rigid support frame carried by said vehicle and having a pair of opposed recesses the centers of which are spaced apart by a first distance, linkage means connected to said material handling unit, said linkage means including first and second links pivotally interconnected at one end, first means associated with the opposite end of said first link which is receivable in one of said recesses, and second means associated with the opposite end of said second link which is receivable in the other of said recesses, the sum of the length of said first link, as measured between said first means and the pivotal connection joining said links, and the length of said second link, as measured between said second means and said pivotal connection, being greater than said first distance, means, secured to said unit and operably associated with said first and second links, for moving said links between a first clearance position in which at least one of said first and second means is outside said recesses, and a second engaged position in which said first means and said second means are received in the respective recesses to releasably secure said material handling unit to said vehicle.

2. A quick-release coupling as defined in claim 1 wherein each recess has an open end which faces the opposing recess.

3. A quick-release coupling as defined in claim 2 wherein said means for moving said first and second links includes a third link which has one end interconnected with said one end of said first and second links.

4. A quick-release coupling as defined in claim 3 wherein said material handling unit defines at least one elongated opening, and one of said first and second means is received in said opening, said one means moving in said opening when said first and second links are moved between said first clearance position and said second engaged position, said opening being aligned with one of said recesses when said first and second links are in said second engaged position.

5. A quick-release coupling as defined in claim 3 wherein said material handling unit includes a guide rail, and said third link is received in and is movable along the axis of said guide rail.

6. A quick-release coupling as defined in claim 5 wherein said material handling unit defines a pair of spaced-apart elongated openings, said first and second means each being positioned in one of the openings and being movable in the openings when said first and second links are moved between said first position and said second position, each of the openings being aligned with one of the recesses when said first and second links are in said second position.

7. A quick-release coupling as defined in claim 3 wherein said means for moving said first and second links includes a threaded rod which has one end secured to said material handling unit and an opposite end which is received in a threaded portion of said third link, whereby rotation of said pin in one direction causes said third link to move outwardly and rotation of said pin in the opposite direction causes said third link to move inwardly.

8. A quick-release coupling as defined in claim 3 wherein said first link and said second link are positioned at a first acute angle relative to said third link when said links are in said first clearance position and at a second acute angle relative to said third link when said links are in said second engaged position, said first link and said second link each defining a variable acute angle relative to said third link while being moved between said first clearance position and said second engaged position, said variable acute angle having a numerical valve bounded by said first acute angle and said second acute angle.

9. A quick-release coupling between a vehicle and a material handling unit supported on the vehicle, comprising:

a vehicle frame having a pair of opposed recesses, linkage means connected to said material handling unit, said linkage means including first and second links pivotally interconnected at one end, first means associated with the opposite end of said first link which is receivable in one of said recesses, and second means associated with the opposite end of said second link which is receivable in the other of said recesses, a third link which is axially extendable and retractable and has one end secured to said material handling unit and an opposing end interconnected with said one end of said first and second links, said third link being adapted to move said first and second links between a first position in which the distance between said first means and said second means is less than the distance between said opposed recesses, and a second position in which the distance between said first means and said second means is greater than the distance between said opposed recesses and said first and second means are received in the respective recesses to releasably secure said material handling unit to said vehicle, said material handling unit defining at least one elongated opening, and one of said first and second means being receivable in said opening, said one means being movable in said opening when said first and second links are moved between said first and second positions, said opening being aligned with one said recesses when said first and second links are in said second position.

* * * * *